US010253445B2

(12) United States Patent
Lawson et al.

(10) Patent No.: US 10,253,445 B2
(45) Date of Patent: Apr. 9, 2019

(54) DISPENSER ASSEMBLY FOR A WASHING MACHINE APPLIANCE

(71) Applicant: Haier US Appliance Solutions, Inc., Wilmington, DE (US)

(72) Inventors: Wayne E. Lawson, La Grange, KY (US); Lucius Levon Cole, Louisville, KY (US); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 63 days.

(21) Appl. No.: 15/434,127

(22) Filed: Feb. 16, 2017

(65) Prior Publication Data

US 2018/0230637 A1 Aug. 16, 2018

(51) Int. Cl.
*D06F 39/02* (2006.01)
*D06F 39/12* (2006.01)

(52) U.S. Cl.
CPC ..... *D06F 39/022* (2013.01); *D06F 39/02* (2013.01); *D06F 39/12* (2013.01)

(58) Field of Classification Search
CPC ..... D06F 39/02; D06F 39/022; D06F 39/12
USPC ..... 68/17 R
See application file for complete search history.

(56) References Cited

U.S. PATENT DOCUMENTS

| | | | | |
|---|---|---|---|---|
| 4,160,367 | A * | 7/1979 | Vona, Jr. | D06F 39/022 68/17 R |
| 4,474,312 | A * | 10/1984 | Donoghue | G01F 11/286 222/205 |
| 4,974,750 | A | 12/1990 | Welch | |
| 6,401,499 | B1 * | 6/2002 | Clark | D06F 39/022 68/17 R |
| 9,863,082 | B1 * | 1/2018 | Ayers | D06F 39/02 |
| 2013/0327101 | A1 * | 12/2013 | Leibman | D06F 71/10 68/17 R |
| 2017/0275805 | A1 * | 9/2017 | Jo | D06F 39/12 |

FOREIGN PATENT DOCUMENTS

FR 2621933 A1 4/1989

* cited by examiner

*Primary Examiner* — Joseph L. Perrin
(74) *Attorney, Agent, or Firm* — Dority & Manning, P.A.

(57) ABSTRACT

A dispenser assembly for a washing machine appliance includes a tray and a cup removably mounted to the tray. The tray may define a first aperture and a second aperture, and the cup may also define an aperture. Further, the cup may be movable to a first position and a second position. In the first position, the aperture defined by the cup may be in fluid communication with the first aperture. In the second position, the aperture defined by the cup may be in fluid communication with the second aperture.

14 Claims, 10 Drawing Sheets

DISPENSER ASSEMBLY FOR A WASHING MACHINE APPLIANCE

FIELD OF THE INVENTION

The present disclosure relates generally to dispenser assemblies for appliances, e.g., washing machine appliances.

BACKGROUND OF THE INVENTION

Washing machine appliances generally form wash and rinse fluids to clean clothing articles disposed within a wash basket of the appliance. The wash fluid can include, for example, water and various fluid additives e.g., detergent, fabric softener, and/or bleach. The fluid additives can be mixed with water within a wash chamber of the appliance to form the wash fluid. Various fluid additives may also be added to form the rinse fluid.

To introduce one or more fluid additives into the wash tub, a user can manually add the fluid additives to the wash tub and/or the wash basket. For example, after starting the washing machine appliance, the user can pour detergent directly into the wash basket. Conversely, certain washing machine appliances include features for receiving fluid additives and dispensing the fluid additives. For example, a dispenser assembly which includes a tray or container mounted to a top panel of a washing machine appliance can receive a fluid additive and direct the fluid additive into a wash tub of the appliance.

A separate tray or container is generally provided for each particular fluid additive. Thus, for example, a washing machine appliance can require a container for detergent, a container for fabric softener, and a container for bleach. Certain design constraints can, however, limit the effectiveness of using multiple containers to direct fluid additives into the wash tub.

In particular, the multiple containers must fit within a location of the top panel that is sized for only one container. Thus, the size of each container must be reduced to accommodate the constraints of the location. However, reducing the size of each container makes it more difficult to pour a fluid additive into the containers. In addition, the containers will require additional time to drain the same amount of fluid additive, so the time required to load the fluid additives will increase.

Accordingly, a washing machine appliance with features for improved handling of fluid additives would be useful.

BRIEF DESCRIPTION OF THE INVENTION

Aspects and advantages of the invention will be set forth in part in the following description, or may be obvious from the description, or may be learned through practice of the invention.

In one embodiment, a dispenser assembly for a washing machine appliance includes a tray and a cup removably mounted to the tray. The tray may define a first aperture and a second aperture, and the cup may also define an aperture. Further, the cup may be movable to a first position and a second position. In the first position, the aperture defined by the cup may be in fluid communication with the first aperture. In the second position, the aperture defined by the cup may be in fluid communication with the second aperture.

In another embodiment, a washing machine appliance includes a cabinet defining a wash chamber. The washing machine appliance may also include a top panel mounted to the cabinet. In addition, the washing machine appliance may include a dispenser assembly mounted to the top panel. The dispenser assembly may include a tray and a cup removably mounted to the tray. The tray may define a first aperture and a second aperture, and the cup may also define an aperture. Further, the cup may be movable to a first position and a second position. In the first position, the aperture defined by the cup may be in fluid communication with the first aperture. In the second position, the aperture defined by the cup may be in fluid communication with the second aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
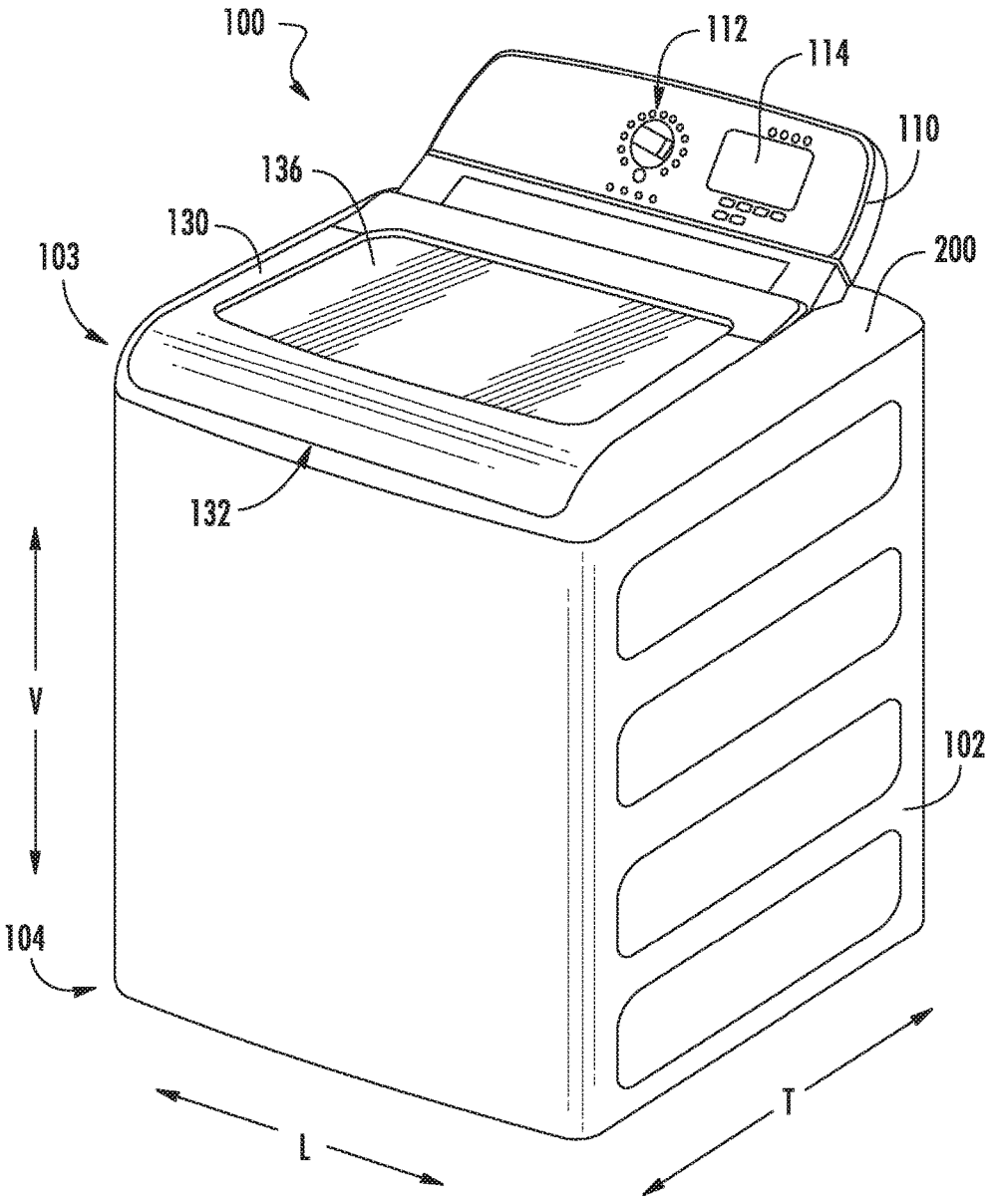
FIG. 1 provides a perspective view of a washing machine appliance in accordance with embodiments of the present subject matter with a lid of the washing machine appliance shown in a closed position.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
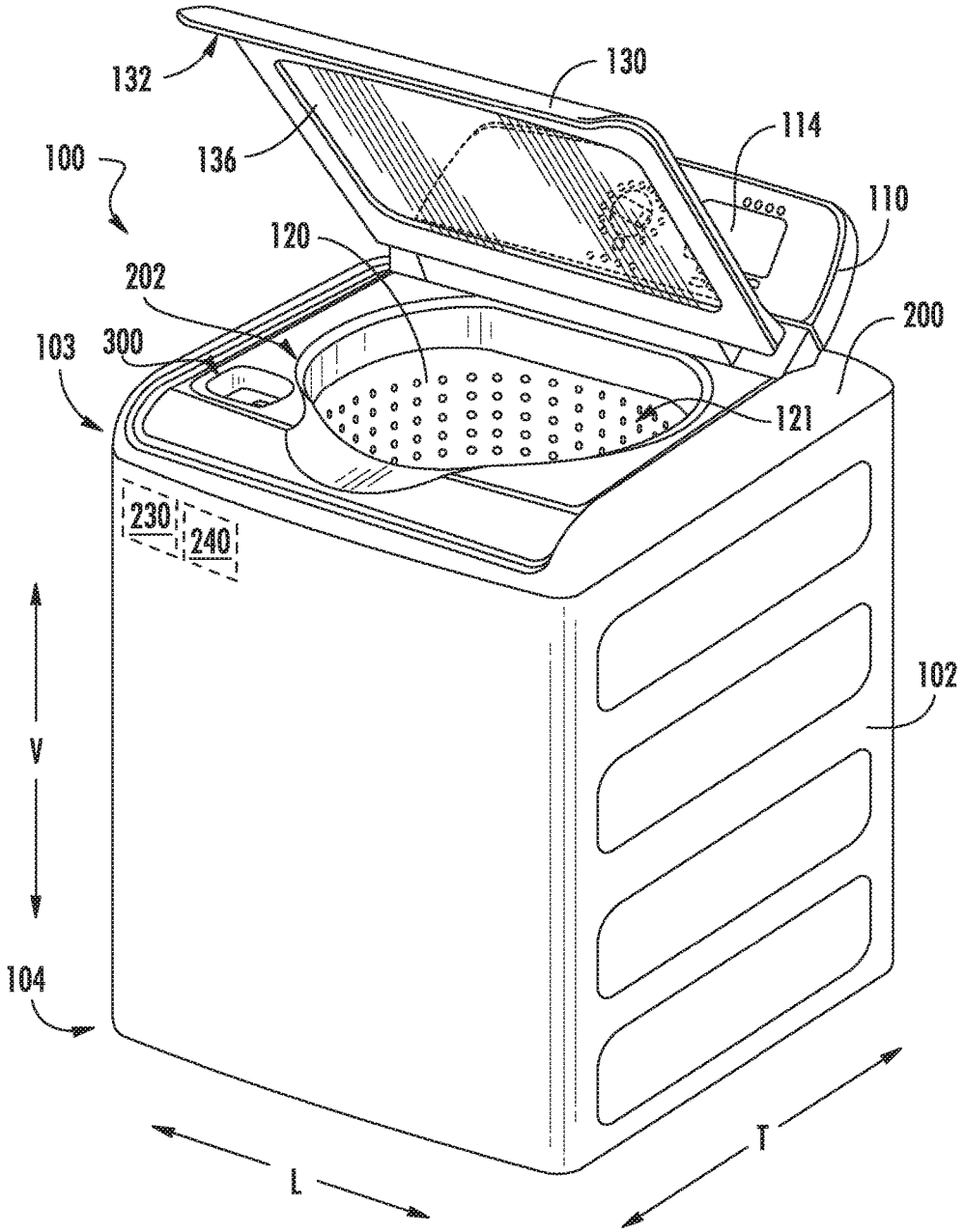
FIG. 2 provides a perspective view of the exemplary washing machine appliance of FIG. 1 with the lid shown in an open position.
Figure 3:
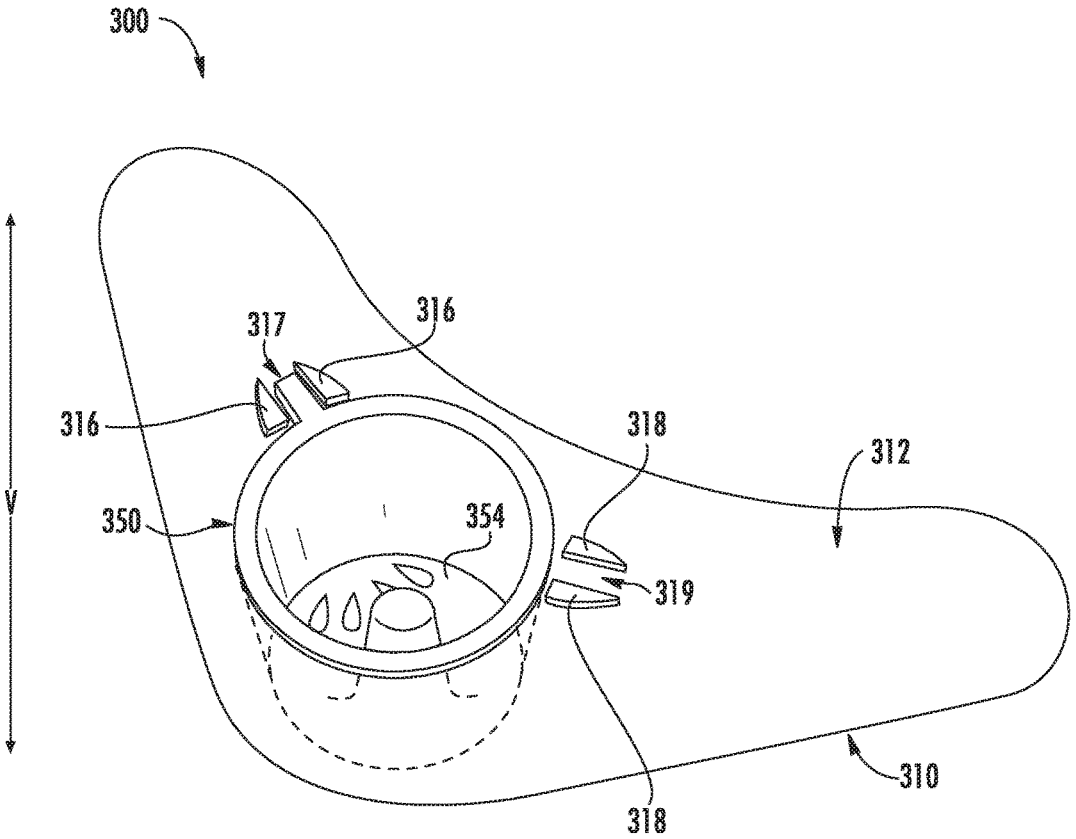
FIG. 3 provides a perspective view of a dispenser assembly in accordance with embodiments of the present disclosure.
Figure 4:
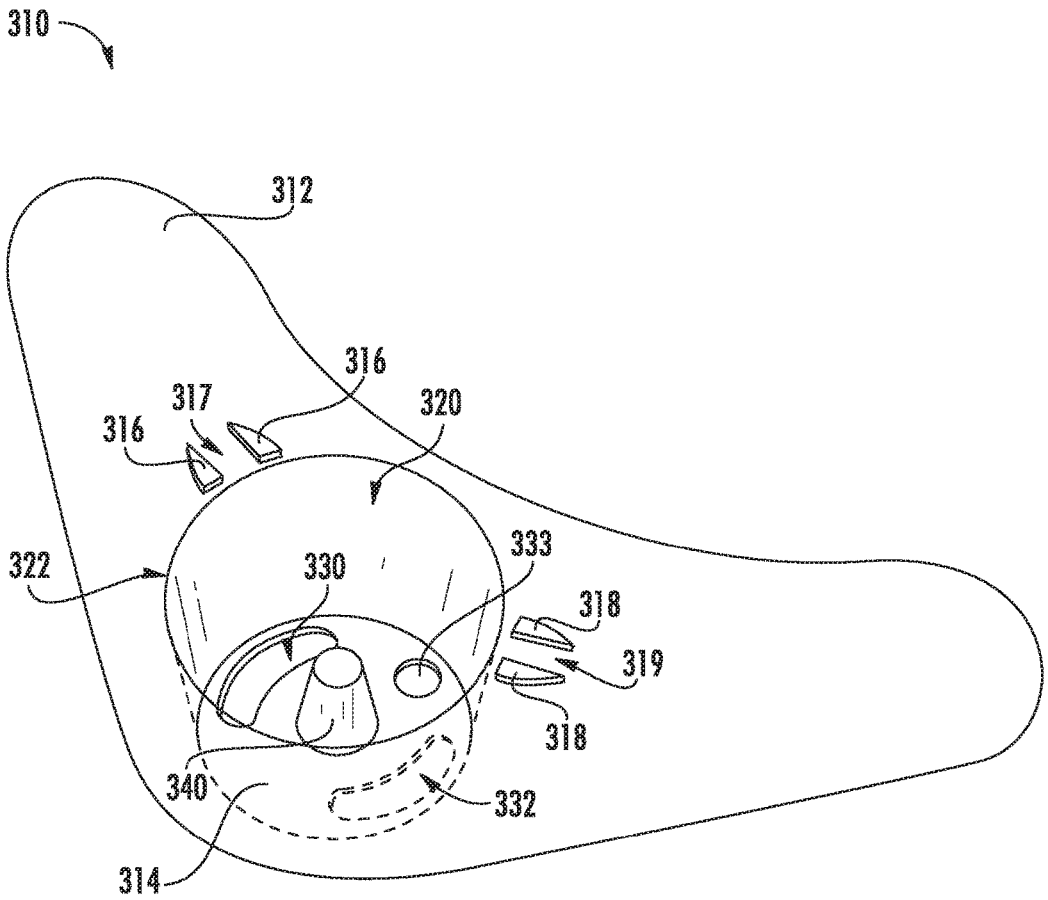
FIG. 4 provides a perspective view of a tray of a dispenser assembly in accordance with embodiments of the present disclosure.

FIGS. 1 and 2 illustrate an exemplary embodiment of a vertical axis washing machine appliance 100. In FIG. 1, a lid or door 130 is shown in a closed position. In FIG. 2, the door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

The washing machine appliance 100 includes a cabinet 102 that extends between a top 103 and a bottom 104 along a vertical direction V. A wash basket 120 (FIG. 2) is rotatably mounted within the cabinet 102. A motor (not shown) is in mechanical communication with the wash basket 120 in order to selectively rotate the wash basket 120 (e.g., during an agitation or a rinse cycle of washing machine appliance 100). The wash basket 120 defines a wash chamber 121 (FIG. 2) that is configured for receipt of articles for washing. An agitator or impeller extends from the wash basket 120 into the wash chamber 121. The impeller assists agitation of articles disposed within the wash chamber 121 during operation of the washing machine appliance 100.

The cabinet 102 of the washing machine appliance 100 has a top panel 200. The top panel 200 defines an opening 202 (FIG. 2) that permits user access to the wash chamber 121 of the wash basket 120. The door 130 is rotatably mounted to the top panel 200. However, alternatively, the door 130 may be mounted to cabinet the 102 or any outer suitable support. The door 130 selectively rotates between the closed position shown in FIG. 1 and the open position shown in FIG. 2. In the closed position, the door 130 inhibits access to the wash chamber 121. Conversely, in the open position, a user can access the wash chamber 121. A window 136 in the door 130 permits viewing of the wash chamber 121 when the door 130 is in the closed position, e.g., during operation of the washing machine appliance 100. The door 130 also includes a handle 132 that, e.g., a user may pull and/or lift when opening and closing the door 130.

The washing machine appliance 100 includes a control panel 110 that extends from the top panel 200. The control panel 110 includes a plurality of input selectors 112 (FIG. 1). The control panel 110 and input selectors 112 collectively form a user input interface for operator selection of machine cycles and any other suitable feature of the washing machine appliance 100. In addition, the control panel 110 includes a feedback device 114. In some embodiments, the feedback device 114 displays selected features, a countdown timer, and/or any other items of interest to appliance users.

Operation of the washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items are loaded into the wash chamber 121 through the opening 202, and washing operation is initiated through operator manipulation of the input selectors 112. The wash basket 120 is filled with water and detergent to form a wash fluid. One or more valves (not shown) can be controlled by washing machine appliance 100 to provide for filling wash basket 120 to the appropriate level for the amount of articles being washed. Once the wash basket 120 is properly filled with fluid, the contents of the wash chamber 121 are agitated by the impeller for cleansing of laundry items in the wash basket 120.

After the agitation phase of the wash cycle is completed, the wash basket 120 is drained. Laundry articles can then be rinsed by again adding fluid to the wash basket 120, depending on the particulars of the cleaning cycle selected by a user, the impeller may again provide agitation within the wash chamber 121. One or more spin cycles may also be used. In particular, a spin cycle may be applied after the wash cycle and/or after the rinse cycle in order to wring wash fluid from the articles being washed. During a spin cycle, the wash basket 120 is rotated at relatively high speeds. After articles disposed in the wash basket 120 are cleaned and/or washed, the user can remove the articles from the wash basket 120, e.g., by reaching into the wash chamber 121 through the opening 202.

The washing machine appliance 100 may include a bleach receptacle 230 and a detergent receptacle 240. As shown, the bleach and detergent receptacle 230, 240 may be positioned between the top panel 200 and the bottom portion 104 of the washing machine appliance 100 along the vertical direction V. It should be appreciated, however, that the bleach and detergent receptacles 230, 240 may be positioned at any suitable location within the washing machine appliance.

As shown, the washing machine appliance 100 may include a dispenser assembly 300. In some embodiments, the dispenser assembly 300 may be mounted to the top panel 200. More specifically, the dispenser assembly 300 may be positioned within an aperture defined by the top panel 200. The dispenser assembly 300 may be in fluid communication with the wash chamber 121, the bleach receptacle 230, and the detergent receptacle 240. Accordingly, the dispenser assembly 300 may direct a fluid additive (e.g., bleach, detergent) into one of the wash chamber 121, the bleach receptacle 230, and the detergent receptacle 240.

FIGS. 3-8 depict the dispenser assembly 300 in accordance with an embodiment of the present disclosure. As shown, the dispenser assembly 300 defines a vertical direction V. In addition, the dispenser assembly 300 includes a tray 310 (FIG. 4) having a top portion 312 and a bottom portion 314. The top and bottom portions 312, 314 are spaced apart from one another along the vertical direction V. The top portion 312 includes a first detent 316 and a second detent 318. The first and second detents 316, 318 may be raised relative to the top portion 312 of the tray 310. In addition, the first and second detents 316, 318 may be circumferentially spaced from one another. In some embodiments, the first and second detents 316, 318 may each include multiple detents (e.g., two or more). As shown, the first detent 316 may include a pair of detents circumferentially spaced from one another such that a gap 317 is defined therebetween. In addition, the second detent 318 may include a pair of detents circumferentially spaced from one another such that a gap 319 is defined therebetween. It should be appreciated that the gap 317 defined by the first detent 316 is circumferentially spaced from the gap 319 defined by the second detent 318.

The tray 310 defines a cavity 320 extending between the top and bottom portions 312, 314 along the vertical direction V. More specifically, the top portion 312 of the tray 310 defines an opening 322, and the cavity 320 extends between the opening 322 and the bottom portion 314 along the vertical direction V. It should be appreciated that the opening 322 may define any suitable cross-section. For example, in one embodiment the opening 322 may define a circular cross-section.

The tray 310 may also define a first aperture 330 and a second aperture 332. In some embodiments, the first and second apertures 330, 332 may be defined by the bottom portion 314 of the tray 310. In addition, the first and second apertures 330, 332 may be circumferentially spaced from one another. It should be appreciated that the first and second apertures 330, 332 may define any suitable shape. As an example, the first and second apertures 330, 332 may each define an oval shape.

The tray 310 may also define a third aperture 333. In some embodiments, the third aperture 333 may be defined by the bottom portion 314 of the tray 310. In addition, the third aperture 333 may be positioned between the first and second aperture 330, 332. It should be appreciated that the third aperture 333 may define any suitable shape. For example, the third aperture 333 may define a circular cross-section.

Figure 5:
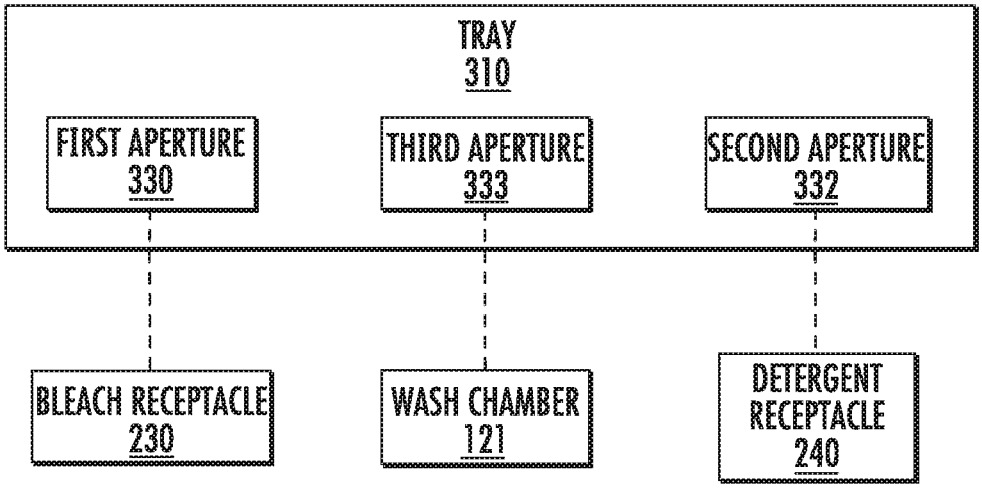
FIG. 5 provides a schematic view illustrating fluid communication between the tray and FIG. 6 provides a perspective view of a cup of a dispenser assembly in accordance with embodiments of the present disclosure.

Referring briefly to FIG. 5, the first, second, and third apertures 330, 332 and 333 may be in fluid communication with various components of the washing machine appliance. More specifically, the first aperture 330 may be in fluid communication with the bleach receptacle 230; the second aperture 332 may be in fluid communication with the detergent receptacle 240; and the third aperture 333 may be in fluid communication with the wash chamber 121.

Referring again to FIG. 4, the tray 310 may also define a connector 340. As shown, the connector 340 may be a male connector that extends from the bottom portion 314 along the vertical direction V. More specifically, the connector 340 may extend from the bottom portion 314 towards the opening 322 along the vertical direction V. As such, the connector 340 may be positioned within the cavity 320 defined by the tray 310. Additionally, the connector 340 may be positioned between the first and second apertures 330, 332. In alternatively embodiments, the connector 340 may be a female connector.

Figure 6:
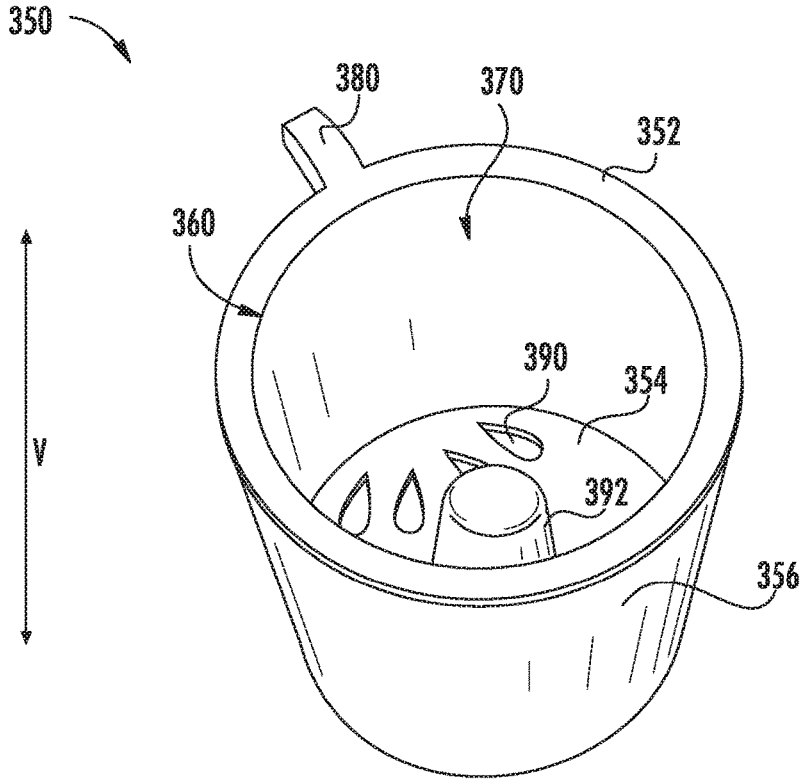

Referring now to FIG. 6, the dispenser assembly 300 also includes a cup 350 that may be removably mounted to the tray 310. The cup 350 includes a top portion 352 and a bottom portion 354. As shown, the top and bottom portions 352, 354 are spaced apart from one another along the vertical direction V. The cup 350 also includes a side wall 356 that extends between the top and bottom portions 352, 354 along the vertical direction V. It should be appreciated, however, that the cup 350 may have any suitable shape. In some embodiments, the cup 350 may be a funnel having a conical shape.

As shown, the top portion 352 of the cup 350 defines an opening 360. In addition, the cup 350 defines a cavity 370 extending between the opening 360 and the bottom portion 354 along the vertical direction V. Alternatively, or in addition, the cup 350 may define a handle 380. More specifically, the handle 380 may be defined by the top portion 352 of the cup 350.

The cup 350 may also define an aperture 390. As shown, the aperture 390 may be defined by the bottom portion 354 of the cup 350. In one embodiment, the aperture 390 may comprise a plurality of apertures. It should be appreciated that the aperture 390 may have any suitable shape. For example, the aperture 390 may have a tear-drop shape. In an alternative embodiment, the aperture 390 may have a circular shape.

Figure 7:
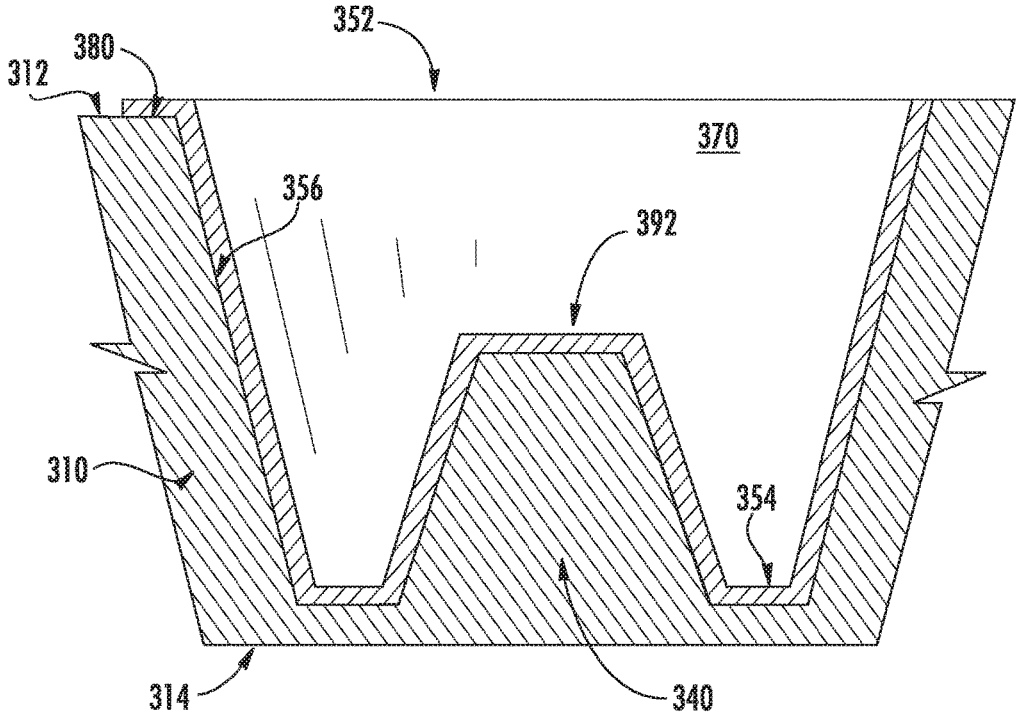
FIG. 7 provides a cross-sectional view of a dispenser assembly in accordance with embodiments of the present disclosure.

The cup 350 may also define a connector 392. In one embodiment, the connector 392 may be a female connector that extends from the bottom portion 354 along the vertical direction V. In particular, the connector 392 may extend towards the opening 360. Accordingly, the connector 392 may be positioned within the cavity 370. In alternative embodiments, the connector 392 may be a male connector. As shown in FIG. 7, the connector 340 engages the connector 392 when the cup 350 is mounted to the tray 310. Further, at least a portion of the cup 50 is positioned within the cavity 320 when the cup 350 is mounted to the tray 310.

As will be discussed below in more detail, the cup 350 is movable to at least a first position (FIG. 8) and a second position (FIG. 9) such that a fluid additive within the cavity 370 is directed into one of the bleach receptacle 230 and the detergent receptacle 240. In one embodiment, a user may move the cup 350 from the first position to second position by dismounting the cup 350 from the tray 310, repositioning the cup 350 to the second position, and remounting the cup 350 to the tray 310. In another embodiment, the cup 350 may rotate from the first position to the second position, or vice versa, when the cup 350 is mounted to the tray 310. In particular, a portion of the cup 350 may be positioned within the cavity 320 when the cup 350 is mounted to the tray 310.

Figure 8:
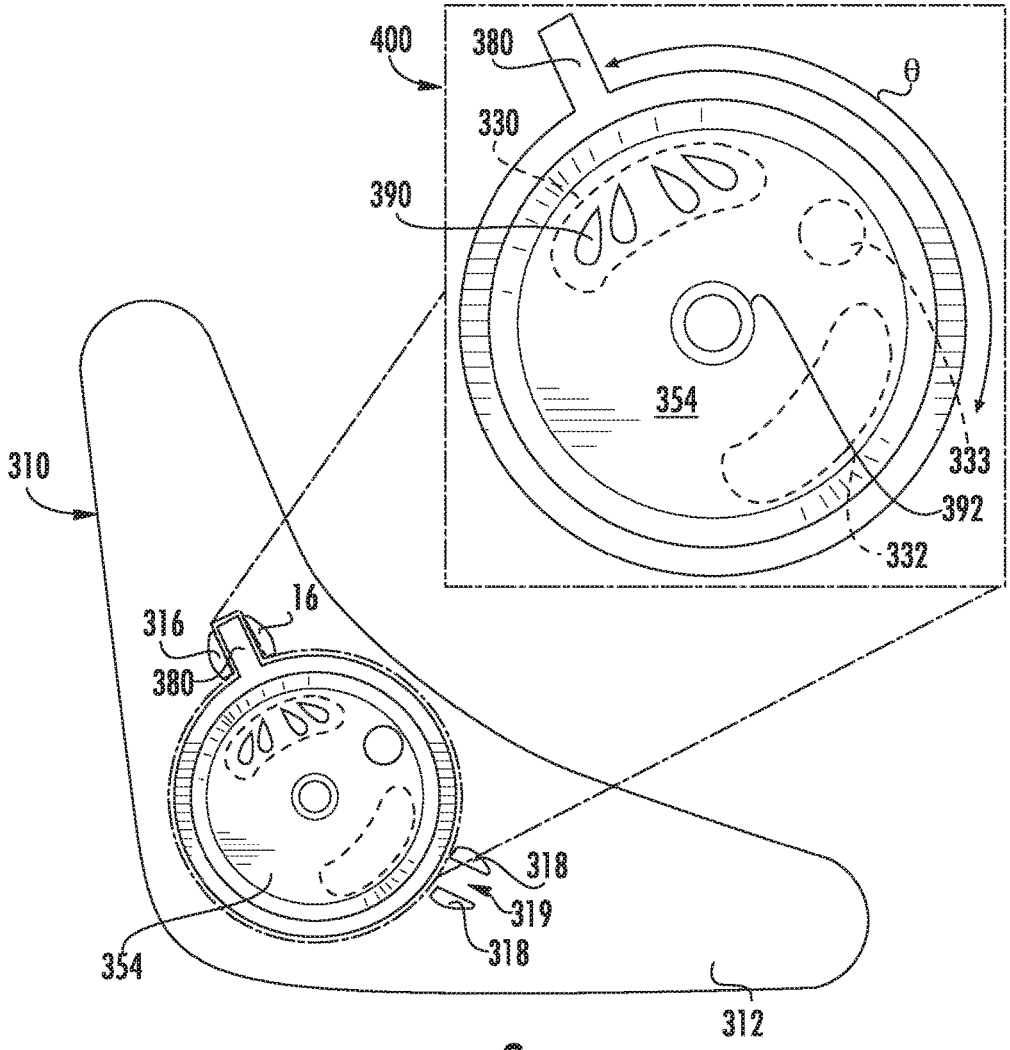
FIG. 8 provides a top-down view of a dispenser assembly in accordance with embodiments of the present disclosure with a cup of the dispenser assembly shown in a first position.
Figure 9:
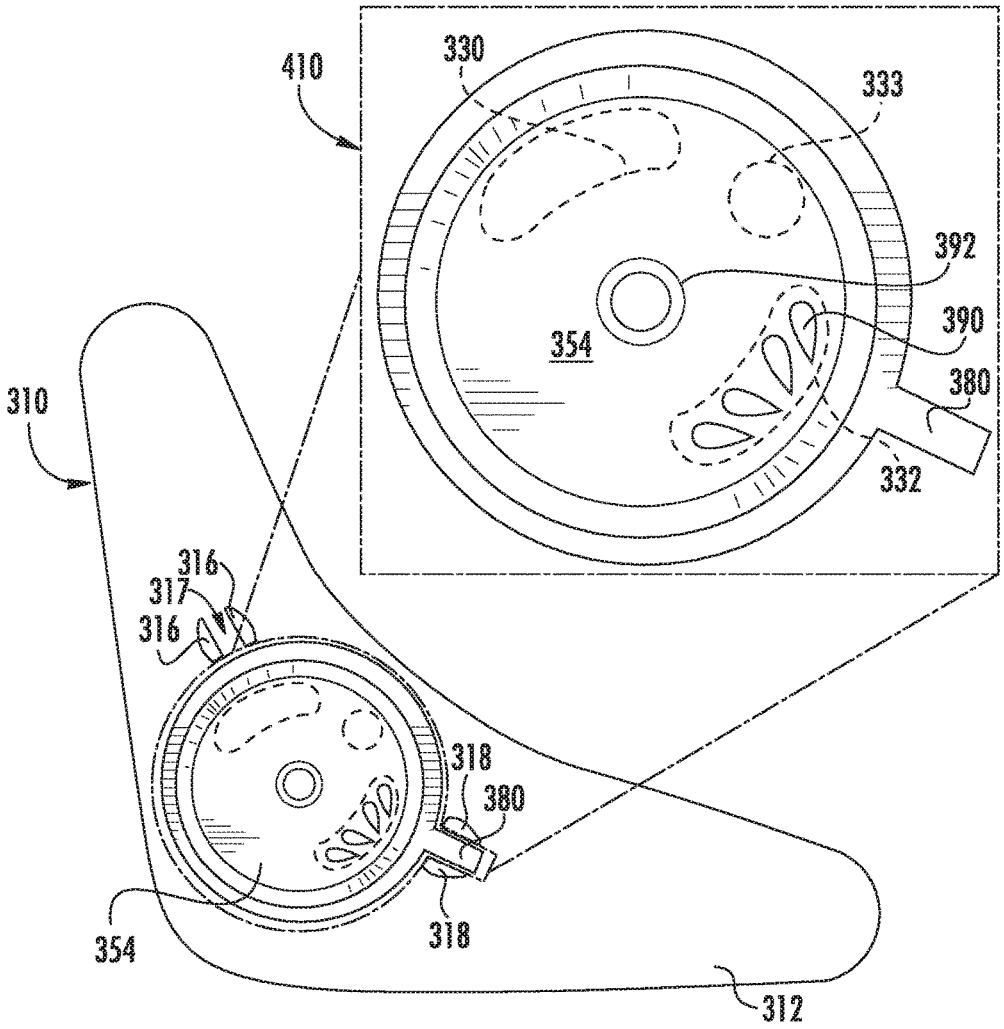
FIG. 9 provides a top-down view of a dispenser assembly in accordance with embodiments of the present disclosure with a cup of the dispenser assembly shown in a second position.
Figure 10:
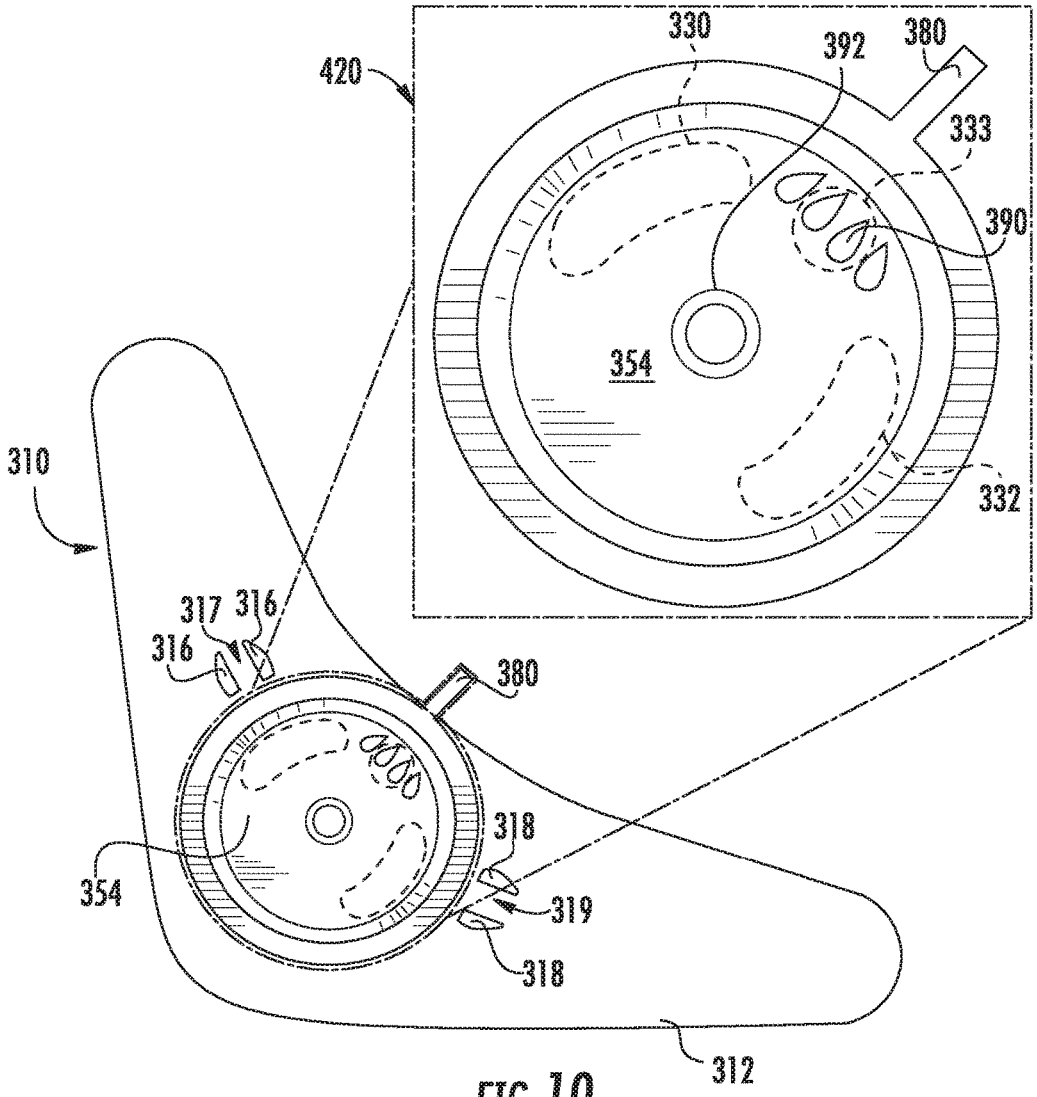
FIG. 10 provides a top-down view of a dispenser assembly in accordance with embodiments of the present disclosure with a cup of the dispenser assembly shown in an intermediate third position.

Referring now to FIGS. 8-10, the cup 350 may be rotatable relative to the tray 310. More specifically, the cup 350 may be positioned within the cavity 320 (FIG. 4) and may rotate relative to the connector 340 (FIG. 7). As shown, the cup 350 may rotate to the first position 400 (FIG. 8), the second position 410 (FIG. 9), and an intermediate third position 420 (FIG. 10). It should be appreciated that the cup 350 rotates through an arc of rotation θ when the cup 350 rotates between the first and second positions 400, 410. It should also be appreciated that the arc of rotation θ may be any suitable value. For example, in one embodiment, the arc of rotation θ may be between 5 degrees and 300 degrees.

As will be discussed below in more detail, a user may rotate the cup 350 to one of the positions 400, 410 and 420 such that a fluid additive within the cavity 370 is directed into one of the bleach receptacle 230, the detergent receptacle 240, and the wash chamber 121. For example, if the user intends to add bleach to the bleach receptacle 230, the user may rotate the cup 350 to the first position 400 via the handle 380. Alternatively, if the user intends to add laundry detergent to the detergent receptacle 240, the user may rotate the cup 350 to the second position 410 via the handle 380. Also, if the user intends to add a fluid additive (e.g., bleach, laundry detergent, etc.) directly into the wash chamber 121, then the user may rotate the cup to an intermediate third position 420 via the handle 380.

When the cup 350 is in the first position 400 (FIG. 8), the handle 380 is positioned within first detent 316. More specifically, the handle 380 is positioned within the gap 317 defined by the first detent 316. In addition, the aperture 390 defined by the cup 350 is in fluid communication with the first aperture 330. Thus, a fluid additive (i.e., bleach) within the cavity 370 may flow through the first aperture 330 and into the bleach receptacle 230. It should be appreciated that the first aperture 330 may be in direct or indirect fluid communication with the bleach receptacle 230. For example, the first aperture 330 may be in fluid communication with a conduit that extends between the first aperture 330 and an inlet of the bleach receptacle 230.

When the cup 350 is in the second position 410 (FIG. 9), the handle 380 is positioned within the second detent 318. More specifically, the handle 380 is positioned within the gap 319 defined by the second detent 318. In addition, the aperture 390 is no longer in fluid communication with the first aperture 330. Instead, the aperture 390 is in fluid communication with the second aperture 332. Thus, a fluid additive (i.e., laundry detergent) within the cavity 370 may flow through the second aperture 332 and into the detergent receptacle 240. It should be appreciated that the second aperture 332 may be in direct or indirect fluid communication with the detergent receptacle 240. For example, the second aperture 332 may be in fluid communication with a conduit that extends between the second aperture 332 and an inlet of the detergent receptacle 240.

When the cup 350 is in the intermediate third position 420, the aperture 390 is in fluid communication with neither the first aperture 330 nor the second aperture 332. Instead, the aperture 390 is in fluid communication with the third aperture 333. Thus, a fluid additive (e.g., bleach, laundry detergent) within the cavity 370 may flow through the third aperture 333 and directly into the wash chamber 121. It should be appreciated that the intermediate third position 420 is located between the first and second positions 400, 410 along the arc of rotation θ. As an example, the intermediate third position 420 may be halfway between the first and second position 400, 410. It should be appreciated, however, that the intermediate third position may be positioned at any suitable location between the first and second positions 400, 410.

The dispenser assembly 300 of the present disclosure provides numerous advantages. For example, the dispenser assembly 300 eliminates the need for separate trays for each type of fluid additive (e.g., bleach, detergent), because a user may move the cup 350 to one of the first and second positions 400 and 410 in order to direct the fluid additive into one of the bleach receptacle 230 and detergent receptacle 240. Further, in some embodiments the user may rotate the cup 350 between the first and second positions 400, 410 when the cup 350 is mounted to the tray 310. In addition, the cup 350 may rotate to the intermediate third position 420 to direct the fluid additive into the wash chamber 121. Furthermore, the size of the cup 350 can increase to utilize space that was previously occupied by the additional trays (e.g., a bleach tray, a detergent tray) that were required. The increased size of the cup 350 is beneficial, because the increased size lowers the likelihood of spilling the fluid additive while it is being poured into the cup 350.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispenser assembly for a washing machine appliance, the dispenser assembly comprising:

a tray comprising a top portion and a bottom portion, the bottom portion configured to be disposed within an opening defined in a top panel of the washing machine appliance, the bottom portion defining a first aperture and a second aperture, the tray further comprising a first detent and a second detent circumferentially spaced from the first detent around an opening defined by the top portion; and a cup removably mounted to the tray, the cup comprising a handle, the cup defining an aperture, wherein the cup is movable to a first position in which the handle is positioned within the first detent and the aperture defined by the cup is in fluid communication with the first aperture, and wherein the cup is movable to a second position in which the handle is positioned within the second detent and the aperture defined by the cup is in fluid communication with the second aperture.

2. The dispenser assembly of claim 1, wherein the first and second apertures are circumferentially spaced from one another.

3. The dispenser assembly of claim 1, wherein the cup rotates through an arc of rotation of between 5 degrees and 300 degrees when the cup rotates between the first and second positions.

4. The dispenser assembly of claim 1, wherein the tray defines a third aperture positioned between the first and second apertures.

5. The dispenser assembly of claim 4, wherein the cup is rotatable to an intermediate third position in which the aperture defined by the cup is in fluid communication with the third aperture.

6. The dispenser assembly of claim 1, wherein the aperture defined by the cup includes a plurality of apertures.

7. The dispenser assembly of claim 1, wherein the first detent and the second detent are raised relative to the top portion of the tray.

8. A washing machine appliance, comprising a cabinet defining a wash chamber;

a top panel mounted to the cabinet; and a dispenser assembly mounted to the top panel, the dispenser assembly comprising:

a tray comprising a top portion and a bottom portion, the bottom portion disposed within an opening defined in the top panel, the bottom portion defining a first aperture and a second aperture, the tray further comprising a first detent and a second detent circumferentially spaced from the first detent around an opening defined by the top portion; and a cup removably mounted to the tray, the cup comprising a handle, the cup defining an aperture, wherein the cup is movable to a first position in which the handle is positioned within the first detent and the aperture defined by the cup is in fluid communication with the first aperture, and wherein the cup is movable to a second position in which the handle is positioned within the second detent and the aperture defined by the cup is in fluid communication with the second aperture.

9. The washing machine appliance of claim 8, wherein the first and second apertures are circumferentially spaced from one another.

10. The washing machine appliance of claim 8, wherein the tray defines a third aperture positioned between the first and second apertures.

11. The washing machine appliance of claim 10, wherein the cup is rotatable to an intermediate third position in which the aperture defined by the cup is in fluid communication with the third aperture, and wherein a fluid additive within the cup flows through the third aperture and into the wash chamber when the cup is in the intermediate third position.

12. The washing machine appliance of claim 8, further comprising a bleach receptacle and a detergent receptacle, the bleach and detergent receptacle positioned within the cabinet.

13. The washing machine appliance of claim 12, wherein a fluid additive within the cup flows through the first aperture and into the bleach receptacle when the cup is in the first position, and wherein the fluid additive flows through the second aperture and into the detergent receptacle when the cup is in the second position.

14. The washing machine appliance of claim 8, wherein the top portion of the tray contacts a top surface of the top panel.

* * * * *